United States Patent [19]

Allan

[11] Patent Number: 4,841,842

[45] Date of Patent: Jun. 27, 1989

[54] APPARATUS FOR SCABBLING CONCRETE

[75] Inventor: David T. Allan, Rutherglen, Scotland

[73] Assignee: John MacDonald & (Pneumatic Tools) Ltd., Glasgow, Scotland

[21] Appl. No.: 904,564

[22] Filed: Sep. 5, 1986

Related U.S. Application Data

[63] Continuation-in-part of Ser. No. 773,510, Sep. 5, 1985, abandoned, which is a continuation of Ser. No. 690,837, Jan. 14, 1985, abandoned, which is a continuation of Ser. No. 529,550, Sep. 6, 1983.

[51] Int. Cl.[4] ..... F01L 21/02; F01B 7/08

[52] U.S. Cl. ..... 91/234; 91/235; 92/165 R; 92/171.1; 173/116

[58] Field of Search ..... 91/234, 235; 92/165 R, 92/171; 173/116, 134, 125; 404/90; 299/37, 69

[56] References Cited

U.S. PATENT DOCUMENTS

| | | | |
|---|---|---|---|
| 1,640,470 | 8/1927 | Saulia | 91/234 |
| 2,739,570 | 3/1956 | Frantz | 91/234 |
| 3,572,448 | 3/1971 | Marcenuk | 173/115 |
| 3,688,848 | 9/1972 | Vick et al. | 173/116 |
| 4,191,093 | 3/1980 | Compton | 91/234 |
| 4,197,786 | 4/1980 | Pillon | 92/165 R |
| 4,256,014 | 3/1981 | Kroger | 91/235 |
| 4,414,881 | 11/1983 | Devaud | 92/171 |

FOREIGN PATENT DOCUMENTS

| | | | |
|---|---|---|---|
| 67224 | 1/1944 | Norway | 91/234 |
| 154803 | 12/1920 | United Kingdom | 91/234 |

*Primary Examiner*—Edward K. Loock
*Attorney, Agent, or Firm*—Ratner & Prestia

[57] ABSTRACT

There is described apparatus for scabbling concretw which includes a hollow cylinder block having a top and bottom plate between which plates there is provided a smooth sided hollow cylindrical cylinder liner. The piston for reciprocation within the cylinder liner is also provided.

1 Claim, 1 Drawing Sheet

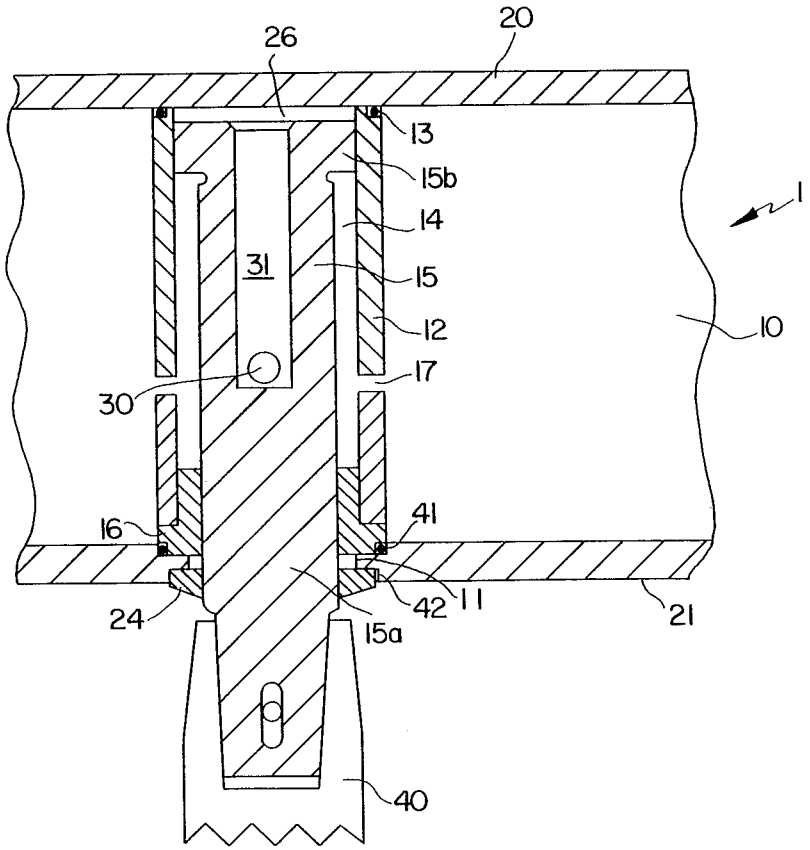
1
10
20
21
13
15b
14
15
12
17
41
11
42
15a
40
26
31
30
16
24

APPARATUS FOR SCABBLING CONCRETE

DETAILS OF RELATED APPLICATIONS

This application is a continuation-in-part of application Ser. No. 773,510, filed 5th Sept. 1985, now abandoned, which in turn is a continuation of application Ser. No. 690,837, filed 14th January 1985, now abandoned, which in turn is a continuation of Application Ser. No. 529,550, filed 6th Sept. 1983, now abandoned.

FIELD OF THE INVENTION

This invention relates to apparatus for scabbling concrete and in particular to pneumatic cylinder and piston arrangements therefor.

DESCRIPTION OF PRIOR ART

Known pneumatically operated apparatus for scabbling concrete includes a cylinder block having a number of bores therein, each bore being provided with a cylinder liner and each bore and liner having a number of internal and external projections or steps so that, in combination with a piston and the cylindrical block, desired operative annular inlet and exhaust spaces are obtained. The provision of these projections or steps in the liner and the block results in a cylinder liner and block which is expensive to produce.

It is an object of the present invention to provide a cylinder block, liner and piston arrangement which is simple in its construction and which does not require intricate machining of the cylinder liner or the block.

SUMMARY OF INVENTION

According to the present invention there is provided apparatus for scabbling concrete comprising:

a hollow cylinder block including a top plate and bottom plate;

means for supplying compressed air to the interior of said cylinder block;

at least one bore formed in said bottom plate;

a cylindrical hollow bush located in said bore and extending within said hollow cylinder block;

a parallel sided cylindrical liner within said cylinder block and surrounding said bush, the liner being in sealing engagement with said top plate and said bottom plate;

a piston slidably located within said liner, means for supplying said compressed air from said cylinder block interior to the interior of said liner;

and scabbling means attached to the end of said piston.

BRIEF DESCRIPTION OF THE DRAWINGS

An embodiment of the present invention will now be described, by way of example, with reference to the accompanying drawings which shows, in section, part of a piston and cylinder arrangement made in accordance with the present invention.

DETAILED DESCRIPTION OF THE PREFERRED EMBODIMENTS

Referring to the drawing, apparatus for scabbling concrete comprises a hollow cylinder block shown generally at 1 having a back plate 10, a top plate 20 and a bottom plate 21. The volume within the hollow block 1 is fed with compressed air through appropriate inlet means (not shown). The bottom plate 21 is provided with a plurality of stepped bores 11, only one of which is illustrated for the sake of clarity. The bore 11 has an upper step 41 and a lower step 42. A flanged cylindrical bush 16 is provided in the upper step 41 of each bore 11, whilst on the outer surface of the lower plate 21, located in the lower step 42, there is provided a wiper ring 24. A cylindrical liner 12 having inner and outer sides which are smooth and parallel and without projections or steps along a substantial part of their length is fitted within the block 10 to surround a respective bush 16. The liner 12 is provided on its top surface with O-ring seals 13. A piston 15 having a piston rod **15*a*, and a head 15*b* is slidably received within each liner 12. An air feed hole 17 is drilled in the liner 12 so that air may be fed from the interior of the block 10 to the annular space 14 defined by the lower face of the piston head 15*b*, the inner wall of the liner 12, the piston rod 15*a*, and the uppermost surface of the flanged bush 16 fitted in the bore 11 of the bottom plate 21 and in which the piston rod 15*a* is a sliding fit. The piston 15 is provided with a radial port 30 in the piston rod 15*a* which communicates with an axial bore 31 in the piston rod 15*a* to permit air in the space 14 to pass to a space 26 above the piston 15. When the piston 15 is in the raised position as illustrated, air in the space 14 is passed to the space 26 causing the piston to move downwards. This motion continues until the radial port 30 moves below the wiper 24 at which time the air is exhausted to atmosphere and, as the space 26 above the piston is no longer in communication with the annular inlet space 14, pressure on the underside of the piston head 15b causes the piston to be raised. The cycle is then repeated. Each of the pistons 15 has a scabbling tool 40** detachably connected thereto in a known manner. Thus, there has been described a piston and cylinder arrangement the constituent elements of which are simple in design and do not require elaborate machining. Modifications and improvements may be incorporated without departing from the scope of the invention as defined by the appended claims.

What is claimed is:

1. Apparatus for cutting concrete comprising: a hollow cylinder block, a top plate for said cylinder block, a bottom plate for said cylinder block, siad cylinder block top plate bottom plate defining a volume within said cylinder bock; inlet means for supplying compressed air to said volume; at least one bore in said bottom plate; an upper step in said bore directed towards the interior of said volume; a lower step in said bore direced to the exterior of the cylinder block; a flanged cylindrical bush provided in the upper step of said bore; a wiper ring located in the lower step of said bore; a parallel sided cylindrical liner located within said cylinder block, one end of the liner being in sealing engagement with said top plate and the other end of the liner surrounding said bush with an end surface of the liner engaging the flange of said cylindrical bush so as to position the liner within said volume; a piston slidably located within said liner and extending through said bush and said wiper ring and having an end positioned outside the cylinder block; aperture means in the wall of said liner for supplying said compressed air from the interior of said cylinder block to the interior of said liner to permit reciprocation of said piston; and cutting means attached to said end of said piston.

* * * * *